United States Patent [19]

Steadings

[11] Patent Number: 4,811,450

[45] Date of Patent: Mar. 14, 1989

[54] VACUUM CLEANER WITH IMPROVED AUXILIARY CLEANING

[75] Inventor: Stephen W. Steadings, Seneca, S.C.

[73] Assignee: Ryobi Motor Products Corp., Pickens, S.C.

[21] Appl. No.: 89,799

[22] Filed: Aug. 27, 1987

[51] Int. Cl.[4] ..... A47L 5/32; A47L 9/00

[52] U.S. Cl. ..... 15/337; 15/331; 15/334; 15/300 A

[58] Field of Search ..... 417/423 A, 442; 15/337, 15/331, 333, 334, 300 A

[56] References Cited

U.S. PATENT DOCUMENTS

| | | | |
|---|---|---|---|
| 2,218,180 | 10/1940 | Schug | 15/337 X |
| 3,217,351 | 11/1965 | Hayba | 15/333 X |
| 4,563,790 | 1/1986 | Clark | 15/337 |

FOREIGN PATENT DOCUMENTS

| | | | |
|---|---|---|---|
| 622469 | 5/1927 | France | 417/423 A |
| 805890 | 12/1958 | United Kingdom | 15/300 A |
| 1351940 | 5/1974 | United Kingdom | 15/334 |

*Primary Examiner*—Harvey C. Hornsby
*Assistant Examiner*—K. L. O'Leary
*Attorney, Agent, or Firm*—David L. Davis

[57] ABSTRACT

A vacuum cleaner main cleaning chassis has a pair of suction air channels leading from a principal suction area thereof. Suction force is provided in common in the air channels with a single suction motor. One of the suction air channels is adapted to receive an auxiliary cleaning hose which diverts the suction force in such air channel into the auxiliary hose. During such auxiliary cleaning, increased suction force may be created in the auxiliary hose by closing off air flow in the other suction air channel, which relieves part of the load on the common suction motor. Such relief results in increased rotational speed of the motor, which in turn correspondingly increases the suction air flow in the air channel associated with the auxiliary hose. In an upright vacuum cleaner, such close-off is accomplished by pivoting the handle and dirt bag carried thereon into an upright position so that a relatively rigid portion of the bag engages against an extended exhaust port corresponding with the suction air channel in which air flow is to be interrupted. The exhaust port corresponding with the air channel in which the auxiliary hose is interposed is not similarly extended, so that auxiliary suction air flow continues unimpeded even when the control handle and bag carried thereon are pivoted into an upright position. The resulting boost in suction air force in the auxiliary hose provides for improved auxiliary cleaning performance.

22 Claims, 4 Drawing Sheets

VACUUM CLEANER WITH IMPROVED AUXILIARY CLEANING

BACKGROUND AND SUMMARY OF THE INVENTION

This invention in general concerns improved performance for a vacuum cleaner when used in an auxiliary cleaning mode, and in particular concerns the provision of increased suction force in an auxiliary cleaning hose attached to an upright vacuum cleaner main cleaning head by partially relieving a common suction motor of such vacuum cleaner from relatively non-productive loads during such auxiliary cleaning.

Vacuum cleaners of different kinds have heretofore been provided with a variety of suction systems, including some of the type having twin suction air channels with suction force therein provided by a common suction motor. Furthermore, when such a twin air channel system is employed in a vacuum cleaner having a main cleaning head defining a principal suction area, it has also been known to in general provide for attachment of an auxiliary hose to such cleaning head for auxiliary cleaning at an alternate suction area with attachments such as crevice tools, dusting brushes, specialized upholstery nozzles, and the like. In particular, the auxiliary hose may be attached to the cleaning head in such manner as to divert suction air flow within one of its two air channels from the principal suction area to the auxiliary hose. However, "non-productive" suction air flow typically continues unimpeded in the other air channel in systems which have only a single common suction motor means for providing suction force in both of the air channels.

The present invention recognizes and brings to light certain improvements in such prior general twin suction air channel systems which particularly result in improved performance during auxiliary cleaning. In particular, the present invention recognizes that interruption of air flow in the suction air channel not associated with an auxiliary cleaning hose will result in a partial unloading or relieving of load from the above-mentioned common suction motor. This occurs, in general, because the commonly-driven fan assembly for such air channel essentially is free to turn without having to do the former work of perpetuating suction air flow (which is selectively interrupted). The present invention also recognizes that interruption of suction air flow in such suction air channel in no way detrimentally impacts vacuum cleaner performance relative the above-described auxiliary cleaning since such suction air flow produces no suction force in the auxiliary cleaning hose.

Moreover, not only does a reduction in the common suction motor load (without any loss of or detriment to auxiliary cleaning power) tend to improve suction motor life and reduce maintenance costs thereof, but it also advantageously permits an increase in the operational speed of such suction motor without requiring any electronic motor control or regulation. Since the rotational speed of the suction motor is directly proportional to the strength of the suction air flow ultimately established in the auxiliary hose, an increase in such rotational speed actually provides correspondingly increased suction air flow (i.e. cleaning power or performance) with the auxiliary hose. Accordingly, it is one general object of the present invention to provide improved auxiliary cleaning performance for a vacuum cleaner of the type having a commonly-powered twin suction air channel system.

It is yet a more particular object of the present invention, especially when adapted for use with an upright vacuum cleaner (i.e. having an extended control handle pivotably mounted on a main cleaning head) having two or more suction air channels, to provide means for simply and efficiently interrupting the suction air flow in the appropriate air channel (or channels) for achieving the more general objects of the invention, as mentioned above. In such upright vacuum cleaner embodiments, it is yet another more particular object of the present invention to achieve selected interruption of the appropriate air channel(s) by selective manipulation of the extended handle of such upright vacuum cleaner.

While different presently disclosed features and their equivalents may be collected to variously form given constructions of an embodiment in accordance with the present invention, and while those of ordinary skill in the art will recognize that various features disclosed herein may be practiced with a variety of types of vacuum cleaners so as to achieve the stated advantages of this invention, several exemplary embodiments in accordance with the present invention are particularly disclosed herewith. For example, one particular construction in accordance with this invention is directed to a vacuum cleaner adapted for use with auxiliary cleaning attachments, such vacuum cleaner comprising: a chassis having a main suction intake port area; suction motor means, supported on such chassis; first and second fan means, commonly driven by suction motor means, for establishing respective suction air flows within the chassis; first and second suction channel means, defined within the chassis, for respectively guiding the suction air flows between the respective fan means and the main suction intake port area so that dust and dirt adjacent the main suction intake port area may be suctioned into the chassis directed towards the fan means along the respective suction channel means; and auxiliary cleaning means for selectively alternatively directing suction air flow within the first suction channel means to a desired alternate suction area outside the chassis for suctioning dust and dirt from adjacent such alternate suction area instead of from adjacent the main suction intake port area, while also temporarily causing interruption of suction air flow within the second suction channel means so as to remove from the second fan means the work load of moving air flow within the second suction channel means, which thereby relieves part of the commonly-driven load of the suction motor means resulting in relatively increased operational speed for the first fan means and correspondingly increased suction air flow in the first suction channel means and at the alternate suction area.

In such an exemplary embodiment, the auxiliary cleaning means may for example particularly include an attachment port with an openable accessory door, adapted to facilitate operative association of an auxiliary cleaning hose with the first suction channel means, and may further include a pair of exhaust ports for exhausting discharge from the fan means, the exhaust ports being structurally distinguished to facilitate differential engagement thereof so that the appropriate (i.e. "non-productive") suction air flow may be interrupted. As further example of such embodiment, the structural distinctions may include one of the exhaust ports extending relatively further rearwardly than the other so as to engage and be sealed by part of a dust bag of an upright vacuum cleaner whenever the handle of same is pivoted generally to an upright position.

Yet another exemplary embodiment incorporating features of the present invention concerns an upright vacuum cleaner with improved auxiliary attachment cleaning, such vacuum cleaner comprising: a mobile chassis comprising a main cleaning head having a main dirt intake opening; a suction motor, carried on the chassis, and having a common output shaft means; a pair of fan elements, one each respectively attached to said common output shaft means, for being rotatably driven by the motor as a common load thereon; fan cover means respectively surrounding each of the pair of fan elements, and providing a suction intake port and a compression output port for each one of the pair; a pair of air channels defined by and within the chassis, one each respectively interconnecting each suction intake port with the chassis main dirt intake opening so as to form an air passage therebetween for suction force established by rotation of the fan elements, so that dirt situated exterior to the chassis and adjacent the main dirt intake opening thereof may be suctioned into the air channels by the suction force established therein with the fan elements; a pair of exhaust ports carried on the chassis and associated with the respective fan cover means output ports so as to conduct discharge therefrom to the exterior of the chassis; handle means, pivotably attached to the chassis, for guiding same; and bag means, supported on the handle means for movement therewith and interconnected with the chassis so as to receive discharge from the two exhaust ports; wherein one of the exhaust ports extends from the chassis an amount adequate so as to be sealed by contact with the bag means whenever same is pivoted with the handle means to a generally upright position, which sealing has the effect of precluding suction air flow in the corresponding fan cover means and air channel so as to in turn reduce the common load on the motor, whereby the rotational speed of the suction motor output shaft means is relatively increased, resulting in corresponding relatively increased suction force in the other air channel, the other air channel being adapted for selected alternative operative association with auxiliary attachment tools.

Still another exemplary embodiment of this invention is represented by an upright vacuum cleaner adapted for principal cleaning with a mobile cleaning head and alternative cleaning with auxiliary attachment tools removably associated with such cleaning head, such vacuum cleaner comprising: a wheel-supported mobile cleaning head having a main chassis, such chassis having a forwardly-located principal suction intake area, and a pair of suction air channels formed rearwardly from such intake area, situated along generally opposite sides of the chassis, and terminating adjacent the rear of the chassis on such respective opposite sides thereof; a suction motor situated adjacent the chassis rear and located generally between the air channel terminations, such motor having a central drive shaft axially aligned between such air channel terminations and extending outward from opposing axial sides of the motor; a pair of fan blade assemblies, one each ofwhich is mounted on the motor drive shaft on a given axial side of the motor, for being rotated by the motor as a common load thereof in a plane generally perpendicular to the axis between the air channel terminations; a pair of covers, one each extending circumferentially about each fan blade assembly, and each having an exhaust opening situated on the rearward side of the chassis; a pair of generally cone-shaped members, one each interconnecting an axially outward side of each cover with a respective one of the air channel terminations, each such cone-shaped member defining a central opening therein for the passage of suction air flow through its respective air channel induced by the rotation of its respective fan blade assembly; a pair of exhaust ports supported on the rear of such chassis and interconnecting respectively with the exhaust openings of each fan blade assembly cover, one of the exhaust ports having a free end extending relatively further rearwardly from such chassis than the other, the extended exhaust port corresponding with a predetermined one of such air channels; a pivoting control handle attached adjacent the rear of the mobile cleaning head for guiding same; a dust bag supported generally along the length of the control handle for pivoting movement therewith relative the chassis, and having a lower end opening thereof which surrounds the pair of exhaust ports; a relatively rigid dirt tube supported internally within such dust bag and operatively interconnected with the exhaust ports so that same at least partially extend into a lower end opening of the dirt tube, such dirt tube having an upper end opening to permit dirt and air forced into the lower end thereof from the exhaust ports to be guided upwardly through and enclosed within the dirt tube so as to be deposited into the top of the dust bag; and an attachment port, associated with the air channel other than the predetermined one thereof, and adapted for selectively permitting attachment of an auxiliary hose to the cleaning head with a flange of such hose introduced into the other air channel for diverting suction air flow within the other air channel into such hose instead of from the principal suction intake area, such hose being adapted for use with auxiliary cleaning implements manipulated independently of the mobile cleaning head; wherein, during auxiliary cleaning with an auxiliary hose attached to the cleaning head, the control handle may be pivoted upward an amount adequate such that the relatively extended exhaust port free end is closed against an internal rear wall of the rigid dirt tube so that suction air flow within the corresponding predetermined one air channel is prevented which in turn removes air flow load from the corresponding fan blade assembly, whereby the common load on the suction motor is relatively reduced so that the rotational speed of the drive shaft thereof is relatively increased for corresponding increased suction air flow in the other air channel for improved auxiliary cleaning.

Those of ordinary skill in the art will recognize numerous modifications and variations which may be made to the above exemplary embodiments of this invention, and particularly will recognize equivalent substitutions, reversal of parts, and the like which may be practiced when applying features of the present invention to different given constructions or types of particular vacuum cleaners, all of which variations are intended to fall within the spirit and scope of the present invention by virtue of present reference thereto.

BRIEF DESCRIPTION OF THE DRAWINGS

A full and enabling disclosure of the present invention, including the best mode thereof, is set forth more particularly in the remaining portion of this specification, together with reference to the accompanying drawings, in which.

Figure 1:
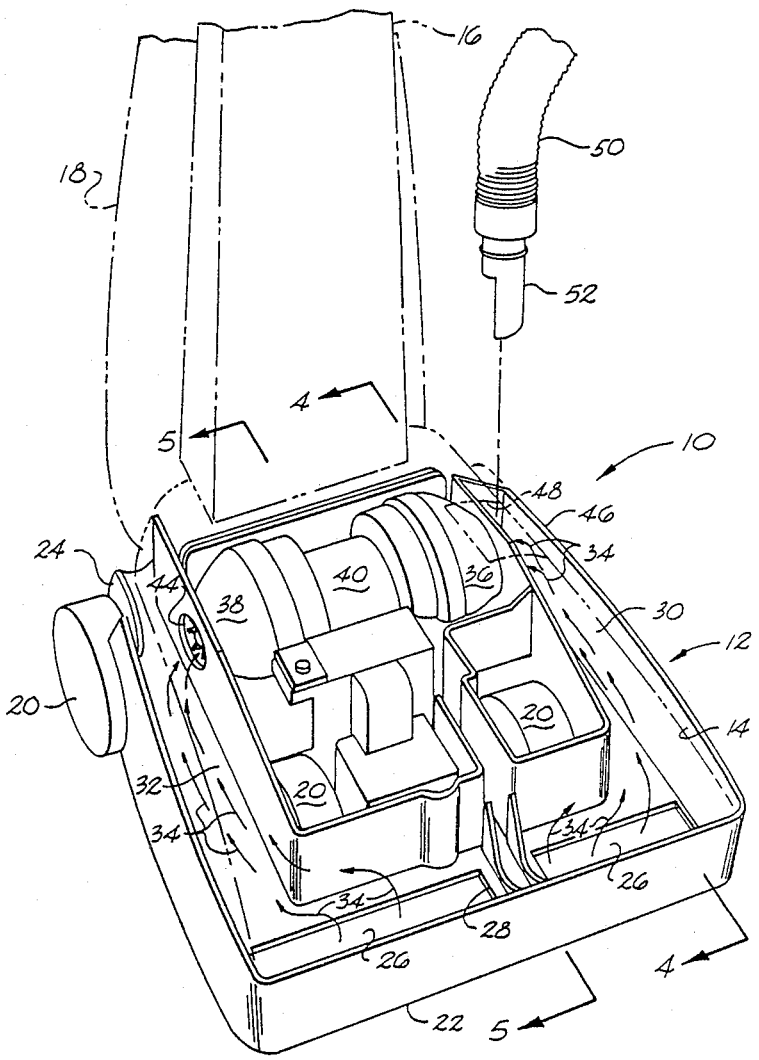
FIG. 1 illustrates a generally frontal, isometric view of an upright vacuum cleaner having an exemplary dual suction air channel system, adapted for receiving an auxiliary cleaning hose, and provided with improved auxiliary cleaning performance in accordance with the present invention.

Repeat use of reference characters throughout the present specification and drawings is intended to represent the same or analogous features or elements of the present invention.

DETAILED DESCRIPTION OF THE PREFERRED EMBODIMENT

Figure 2:
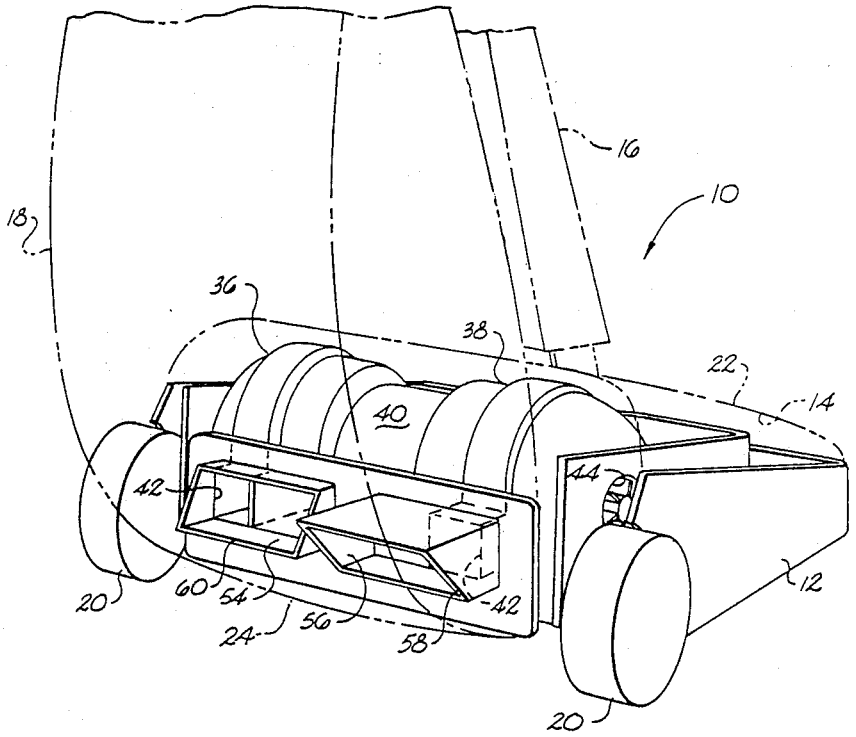
FIG. 2 illustrates a generally rearward-looking isometric view of the embodiment of FIG. 1, and particularly illustrating a pair of exhaust ports having distinguishing structural features in accordance with the present invention.

FIGS. 1 and 2 illustrate generally respective front-looking and reverse-looking isometric views of an upright vacuum cleaner 10 embodying features of the present invention. A main cleaning head 12 has an upper enclosing section 14 thereof illustrated in transparent representation (shown by dotted-line illustration) so that internal chambers, features and the like of cleaning head 12 may be visualized. Section 14 would normally be opaque in an actual device. Likewise, handle means 16 and bag means 18 are illustrated in dotted line so as to provide an unobstructed view of more particular features in accordance with the present invention.

In general, main cleaning head 12 comprises a mobile chassis supported on rotatable wheels 20, as well understood by those of ordinary skill in the art. Mobile chassis 12 includes a generally forward area 22 and rearward area 24. The front section defines principal or main suction intake ports or areas 26, which generally may comprise a forwardly-located slot (in this instance interrupted only by an under-cover 28 for a rotary brush drive belt, not shown). A rotary beater bar brush (also not shown for clarity of illustration) is typically journaled in the forward region of chassis 12 above port area 26 thereof.

A pair of suction air channels 30 and 32 are generally defined by and within chassis 12, and are essentially closed by the top member 14 thereof. The suction air channels guide suction air flow (represented by arrows 34) from the principal suction port area 26 along their respective passageways, located generally on opposite sides of chassis 12, and towards the rear thereof. Such flow of suction air generally rearward in chassis 12 draws dust and dirt adjacent principal suction opening 26 into the chassis and towards first and second fan means 36 and 38, respectively. Such first and second fan means are driven in common by a single suction motor means 40, and separately associated with their respective first and second suction air channel means 30 and 32, respectively. More details of such fan means, and exemplary housing means therefor, are discussed in greater detail below with reference to present FIG. 3.

As illustrated by the reverse isometric view shown in present FIG. 2, each fan means is provided with its own exhaust opening 42, which permits generally rearward discharge from the respective fan means of dust, dirt, and suction air flow directed thereto through housing means openings associated therewith. Only one of such openings 44 may be seen in the views of FIGS. 1 and 2, but a similar such opening also interconnects the rearward terminating end of first air channel means 30 with first fan means 36.

The suction air flow arrows 34 of present FIG. 1 represent operation of upright vacuum cleaner 10 in a principal cleaning mode thereof, i.e. application of suction force to a principal suction intake area 26 of the vacuum cleaner. In the exemplary embodiment illustrated in the accompanying drawings, first suction air channel means 30 is provided with an attachment port means 46, having a selectively openable accessory door 48, such means being adapted to receive an auxiliary hose 50. Hose 50 includes a flange portion 52 which may be received in first air channel means 30 for blocking suction air flow from that portion of air channel means 30 forward of flange 52 (i.e. generally from principal suction area 26), so as to instead direct suction force associated with channel means 30 into auxiliary hose 50. Hence, dust and dirt from an alternate suction area (not illustrated) constituting another end of hose 50 is directed towards first fan means 36. It is recognized by this invention that, during such auxiliary cleaning operation, suction air flow in second air channel means 32 does not contribute to suction force established in auxiliary hose 50.

Present FIG. 2 illustrates a pair of exemplary exhaust ports 54 and 56 which are structurally distinguished from one another in accordance with this invention, and which project or extend generally rearwardly from chassis 12 to facilitate discharge through exhaust openings 42 of dust, dirt, and suction air flow from respective fan means 36 and 38. Exhaust ports 54 and 56 are preferably operatively interconnected with bag means 18 so as to direct discharge from the respective fan means into such bag means, as discussed in greater detail below with reference to FIGS. 4 through 6. While such discharge is segregated between the two air channels up to and through the exhaust ports thereof, the separate discharges become mixed (during principal cleaning) within said bag means for common handling thereby.

Generally in accordance with the present invention, the suction air flow in the suction air channel other than that associated with auxiliary hose 50 is interrupted during an auxiliary cleaning operation so as to partially relieve or unload central suction motor means 40, which results in an increased rotational speed thereof. Since the suction air flow in the air channels is determined by the operational speed of suction motor means 40, the partial relief generated by such air flow interruption in the "unused" air channel results in increased suction force in the air channel used during such auxiliary cleaning. Furthermore, since some vacuum cleaner performance tests are based on the speed and amount of air movement established by the cleaner, auxiliary cleaning performance for a vacuum cleaner embodying this invention is obviously improved.

FIG. 2 more particularly illustrates how features in accordance with the present invention are preferably incorporated into an upright vacuum cleaner 10. In such embodiment, the exhaust port 56 situated for association with second suction air channel means 32 has a free, open end 58 thereof which extends rearwardly relatively further than a corresponding free, open end 60 of exhaust port 54. In this particular exemplary embodiment end 58 defines a planar, angled surface with the uppermost area thereof being more rearwardly projected than its remaining areas (to facilitate sealing thereof, as discussed below), while end 60 defines a planar, angled surface with the lowermost area thereof being more rearwardly projected than its remaining areas (to present sealing thereof). Such relative extension for the one exhaust port is advantageous in that an opposing surface within bag means 18 (discussed more fully with reference to present FIG. 5) may be selectively engaged with end 58 by relative upright pivoting of handle means 16 with bag means 18 supported thereon. Whenever bag means 18 is pivoted upwards (i.e. toward the exhaust ports) an amount adequate to substantially engage free end 58, exhaust port 56 becomes sealed or blocked so that discharge from second fan means 38 is prevented. Thus, suction air flow in fan means 38 and its corresponding suction air channel 32 is interrupted. Such interruption relieves fan means 38 from the work load of moving the air flow otherwise associated therewith, which in turn reduces the common load on suction motor means 40, with the resulting advantages mentioned above.

Figure 3:
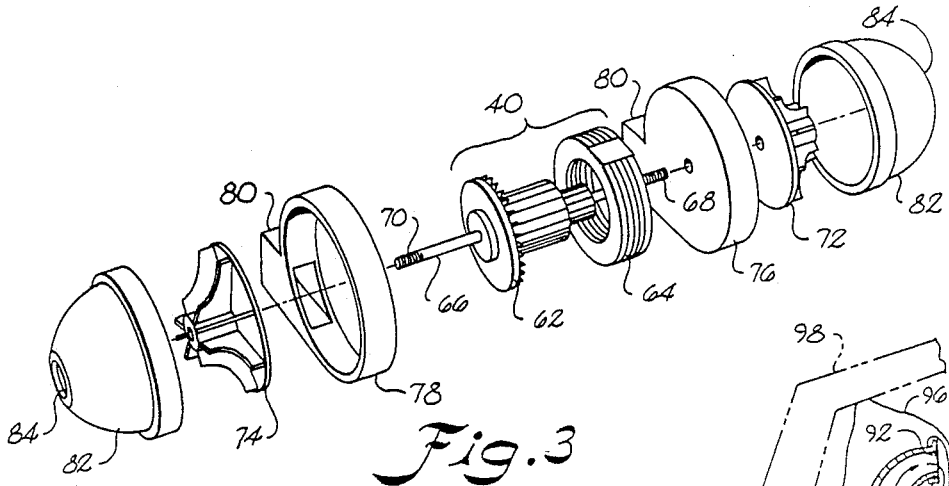
FIG. 3 illustrates an exploded view of an exemplary suction motor and commonly-driven dual fan system for use with an embodiment in accordance with the present invention, such as is illustrated in present FIGS. 1 and 2.

Referring now to FIG. 3, details of an exemplary suction motor, fan means, and housing means for use in practicing the present invention are illustrated in an exploded view. In particular, an armature assembly 62 and matable field element 64 comprises an electric motor forming common suction motor means 40. Since FIG. 3 represents an exploded view, those of ordinary skill in the art recognize that armature assembly 62 is displaced from the axial location it would normally occupy within field element 64 during complete assembly of the vacuum cleaner represented in present FIG. 1. A central or common drive shaft 66 is axially situated within and rotatably driven by suction motor 40. First and second drive ends 68 and 70 of motor 40 are commonly driven by output shaft 66, and respectively rotatably drive first and second fan blade assemblies 72 and 74 secured to such drive ends on axially opposing sides of motor 40. Rotation of such fan blade assemblies by suction motor 40 respectively generates the suction air flows in their corresponding suction air channels 30 and 32, as understood by those of ordinary skill in the art.

Each fan blade assembly is circumferentially surrounded by a respective cover 76 and 78. Each such cover provides a generally rearwardly-directed exhaust output 80 for respective discharge of materials and air flow, as discussed above with reference to exhaust opening 42 of present FIG. 2. Each fan blade assembly cover also engages on an outer axial side thereof a generally cone-shaped member 82 which provides a centrally-situated axial opening 84 therein (corresponding with opening 44 of present FIG. 1) for interconnecting its corresponding suction air channel rearward termination with its respective fan means. Thus, suction air flow generated by rotation of the respective fan blade assemblies 72 and 74 enters their respective intake openings 84 and exits under compression through the exhaust openings 80.

Figure 4:
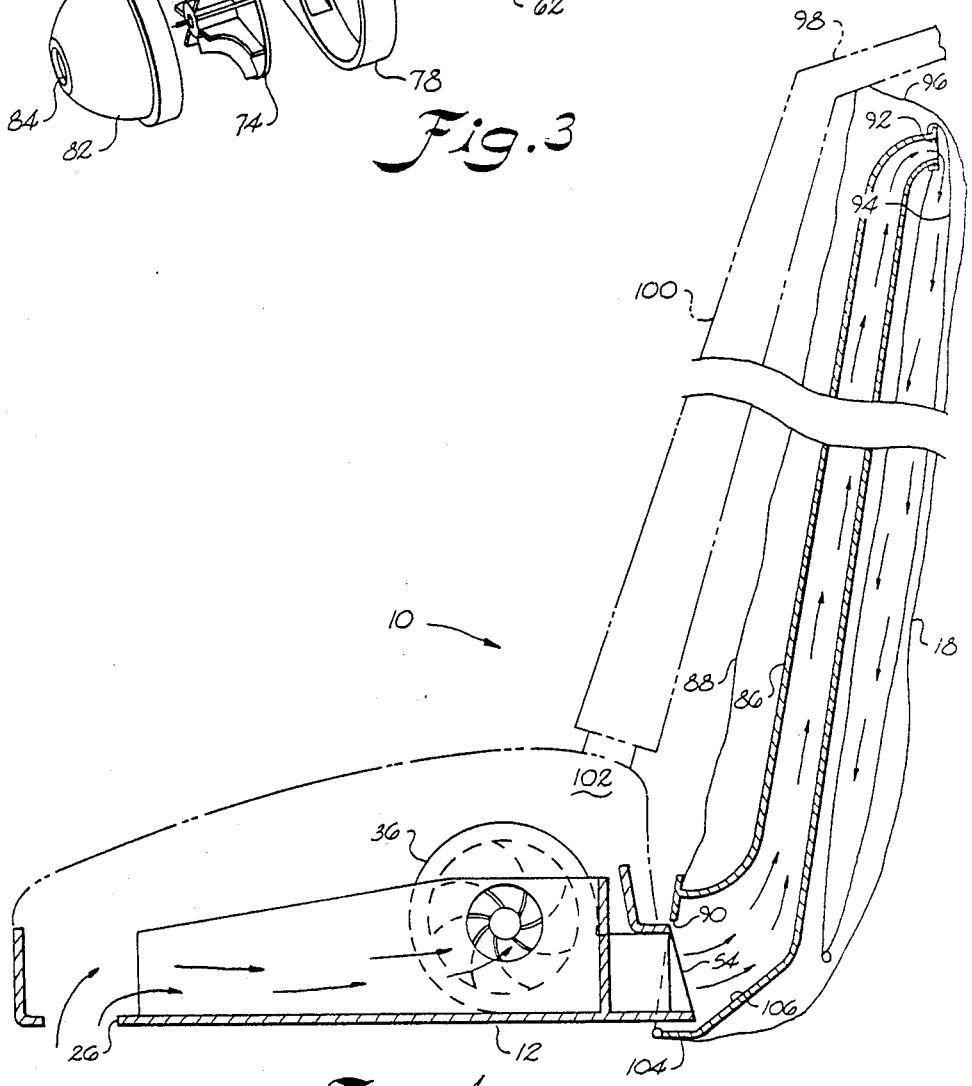
FIG. 4 illustrates a cross-sectional view of the embodiment of FIG. 1 taken along the line 4—4 indicated therein, during a principal or main cleaning mode of such vacuum cleaner.

Since exhaust ports 54 and 56 situated on the rearward side of chassis 12 communicate the discharge therefrom with bag means 18 (as mentioned, supra, with reference to present FIG. 2), the pressurized discharge generally travels upward in a dirt tube 86 received within an outer bag 88, as generally represented by present FIG. 4.

FIG. 4 illustrates a cross-sectional view of vacuum cleaner 10 as shown in present FIG. 1, operating in a principal cleaning mode thereof. First fan means 36 is associated with relatively unextended exhaust port 54 for drawing dust and dirt through principal suction intake area 26 and directing same upward in dirt tube 86 through a lower open end 90 thereof, which is operatively interconnected with both exhaust ports 54 and 56. The "non-extension" characterization of port 54 is intended as relative with reference to port 56 since both ports preferably extend sufficiently to interconnect with open end 90. Dirt tube 86 also preferably includes an upper open end 92 which is adapted to receive a disposable dust bag 94 which hangs from the top of tube 86 inside more permanent-type fabric outer bag 88. A zipper or the like (not illustrated) in the rear of permanent bag 88 permits periodic changing of disposable bag 94, as understood by those of ordinary skill in the art. Upper end 92 of tube 86 is preferably held in place by some internally attached member or the like (not shown) of bag 88, so that dirt tube 86 is affirmatively moved by pivoting of the handle supporting it, as discussed below.

The upper end 96 of bag 88 is in turn preferably supported on an upper end 98 of an extended control handle 100, which is pivotably mounted near area 102 of mobile chassis 12 for guidance and control of same. All of the foregoing components of bag means 18 likewise pivot with control handle 100, though they are attached more at the bottom rear of chassis 12, as illustrated in present FIG. 4. While fabric outer bag 88 has a lower end thereof 104 which generally surrounds both of exhaust ports 54 and 56, the lower end of dirt tube 86 is more directly operatively associated with such exhaust ports, as mentioned above, for directing dirt and exhaust therefrom up to the top 96 of bag 88. Dirt tube 86 preferably comprises a relatively rigid component, such as formed from a vinyl material, which maintains a relatively fixed position within outer bag 88. Tube 86 also preferably at least partially receives exhaust ports 54 and 56 into the interior thereof.

A generally planar surface 106 of dirt tube 86 is situated as an opposing, internal rear wall across from the free, open ends of the exhaust ports. Such angled planar surface 106 is brought into engagement with free end 58 of exhaust port 56 for sealing or closing same whenever the control handle of vacuum cleaner 10 is brought substantially into its upright, storage position. Present FIG. 5 is a partial, crosssectional view taken along the line 5—5 indicated in present FIG. 1, and more particularly illustrates the structure of second fan means 38 and its associated exhaust port 56.

As will be observed by those of ordinary skill in the art, exhaust port 56 extends further relatively rearward from chassis 12 than does exhaust port 54. The additional extended distance is preferably in a range from about ½ of an inch to about 1 inch, although about ¾ of an inch is generally preferred. Of course, variations may be practiced and the examples expressed either specifically or in ranges herein neither limit the concept of or the structure of this exemplary embodiment, nor other embodiments of this invention.

Figure 5:
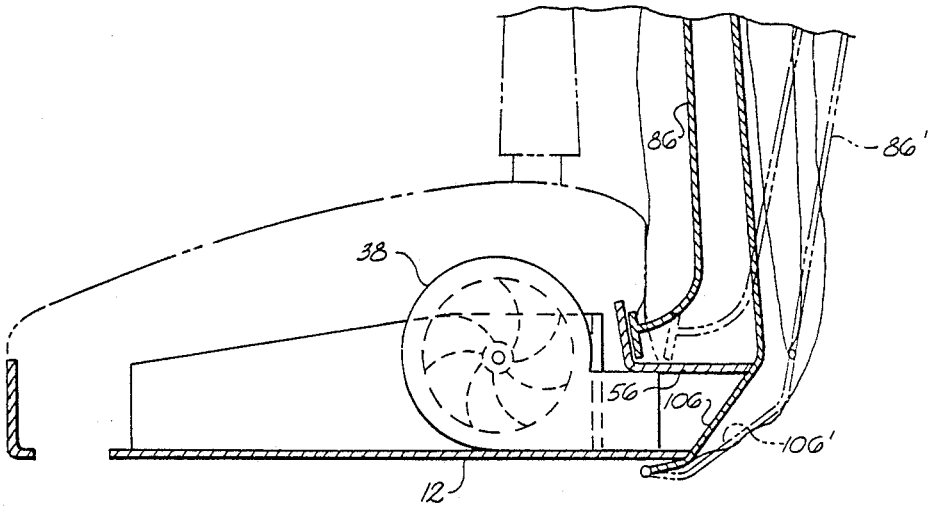
FIG. 5 illustrates a partial cross-sectional view of the embodiment of FIG. 1 in accordance with the present invention taken along the indicated line 5—5 in such figure, illustrating several features of this invention in relation to various control handle positions in conformance with the present invention.

The dotted line representations of 86' of the dirt tube in present FIG. 5 correspond with the solid line illustration thereof in present FIG. 4. As may be clearly observed, the free end of exhaust port 56 is (in such position of the handle and bag means) unobstructed by, i.e. out of contact with, planar surface 106'. However, as the bag means and handle means are pivoted generally upward into an upright, storage position thereof, the position shown by the solid line illustration (see FIG. 5) of dirt tube 86 and the internal planar rear wall 106 thereof is assumed. In such instance, the free open end of exhaust port 56 is obviously sealed or closed by mating engagement with generally planar, angled surface 106. Hence, the suction air flow through fan means 38 is effectively interrupted, as represented by the lack of air flow arrows in present FIG. 5, and a part of the load on common suction motor means 40 is relieved. Such relief ultimately results in increased suction air flow in auxiliary suction passageways, as mentioned above.

As is common in the art, various latch or interlock members are normally actuated to obtain various pivot positions for the handle of an upright vacuum cleaner, but such features form no particular aspects of this invention and hence need not be represented nor discussed in detail.

Figure 6:
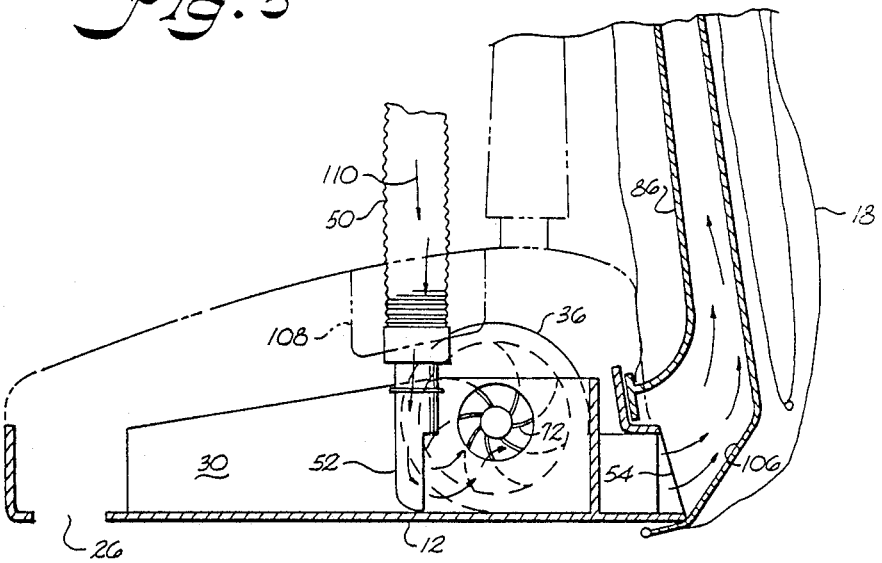
FIG. 6 illustrates a partial cross-sectional view generally taken along the same sectional line 4—4 as that of present FIG. 4, with the exemplary vacuum cleaner configured for use in an auxiliary cleaning mode thereof.

Present FIG. 6 again illustrates the condition of first fan means 36 and its corresponding exhaust port 54 (as seen along the cross-sectional line 4—4 of present FIG. 1), but with dirt tube 86 pivoted generally upright so as to reside in the solid line position thereof as in present FIG. 5. Due to the relative less extension of the free end of exhaust port 54 in comparison with that of exhaust port 56, internal rear wall 106 of dirt tube 86 remains free of (i.e. out of contact with) the end of exhaust port 54 so that suction air flow generated by fan means 36 is uninterrupted. Alternatively, the end of port 54 may be forwardly angled from that of port 56 (as is illustrated) to prevent sealing of port 54 by rear wall 106 since an angled (instead of mating or matching) surface is presented to such rear wall. FIG. 6 further illustrates exemplary insertion of auxiliary hose 50 into an attachment port means 108 of chassis 12, as discussed above with reference to present FIG. 1. Flange 52 is interposed in first suction air channel means 30 so as to divert suction force from principal suction area 26 to an alternate suction area, as explained above. Thus, auxiliary cleaning suction force, represented by arrows 110, is directed along auxiliary hose 50, through first fan means 36, out corresponding exhaust port 54 thereof, and into dirt tube 86 for ultimate deposit of dust, dirt or the like in bag means 18. Such auxiliary suction cleaning force 110 is correspondingly increased by an increase in the rotational speed of fan blade assembly 72 due to the common load relief obtained through closure of exhaust port 56 with planar member 106, as in present FIG. 5. Accordingly, improved auxiliary cleaning performance results.

While a particular exemplary embodiment of the present invention has been illustrated above, various modifications and variations thereto, including substitution of equivalent structures when incorporating features of the present invention into given vacuum cleaner constructions, may be practiced by those of ordinary skill in the art and are included features of this invention. For example, the particular cross-sectional shape of exhaust ports 54 and 56 need not be rectangular as generally illustrated, but may assume other shapes, such as that of a parallelogram, or other, non-quadrilateral shapes. Likewise, the particular angle of the free, open ends 58 and 60 of the exhaust ports need not assume the general angles illustrated, but may be varied as selected by those of ordinary skill in the art in providing a given construction in accordance with the present invention, so long as structurally differentiated characteristics (or equivalents thereof) are maintained so that various surfaces or the like of a particular bag construction (or substitute actuation structure) may be used for selectively sealing the exhaust port associated with the suction air channel which is "unused" during an auxiliary cleaning mode. Alternatively, other structures may be provided as equivalents to the present invention for selectively closing such exhaust port, or interrupting such "unused" suction air flow, even without use of a pivoting handle means, or even for given vacuum cleaner constructions other than upright models. All such variations and equivalent structures are intended to fall within the spirit and scope of the present invention.

Furthermore, while the present invention has chiefly been described and explained with reference to an air channel system having two separate passageways provided with suction force from a common suction motor, the concepts herein are equally applicable to any presently existing or future vacuum cleaner having three or more such commonly-powered passageways, with one such passageway adapted for auxiliary cleaning. For example, all of the remaining passageways other than the "auxiliary cleaning" one could have their suction air flows variously interrupted as discussed herein with respect to second suction air channel means 32.

While a particular exemplary embodiment has been expressly described with particular choice of words, all such words are intended as words of description and example only, and not as words of limitation with respect to the present invention, which invention is defined more particularly in the appended claims.

What is claimed is:

1. A vacuum cleaner adapted for use with auxiliary cleaning attachments, said vacuum cleaner comprising:

a chassis having a main suction intake port area;

suction motor means supported on said chassis;

first and second and means, commonly driven by said suction motor means, for establishing respective suction air flows within said chassis;

first and second suction channel means, defined within said chassis, for respectively guiding said suction air flows between said respective fan means and said main suction intake port area so that dust and dirt adjacent said main suction intake port area may be suctioned into said chassis directed towards said fan means along the respective suction channel means;

auxiliary cleaning means for selectively alternatively directing suction air flow within said flow suction channel means to a desired alternate suction area outside said chassis for suctioning dust and dirt from adjacent such alternate suction area instead of from adjacent said main suction intake port area; and air flow blocking means for causing interruption of suction air flow within said second suction channel means so as to remove from said second fan means the work load of moving air flow within said second suction channel means, which thereby relieves part of the commonly-driven load of said suction motor means resulting in relatively increased operational speed for said first fan means and correspondingly increased suction air flow in said first suction channel means and at said alternate suction area.

2. A vacuum cleaner as in claim 1, further comprising:

handle means pivotally attached to and extending from said chassis for guiding same:

bag means supported on said handle means and operatively interconnected with said chassis; and respective exhaust outputs for each of said fan means, said exhaust outputs facilitating discharge into said bag means from said fan means of dust, dirt, and suction air flow directed thereto; and wherein said auxiliary cleaning means includes an attachement port with an openable accessory door for selectively providing access to said first suction channel means, and adapted for removably engaging an auxiliary cleaning hose of the type having an extended flange member for being received in and diverting suction air flow in said first suction channel means from said main suction intake port area so that such suction air flow is channeled into the auxiliary hose, the other end of which hose constitutes an alternate suction area, and wherein said air flow blocking means includes a pair of exhaust ports respectively interconnecting the exhaust outputs from said first and second fan means to the exterior of said chassis for discharge into said bag means, said exhaust ports being structurally distinguished from one another so that the one exhaust port corresponding with said second fan means is adapted to automatically engage said bag means as same is pivotably carried on said handle means towards said exhaust ports, whereby movement of said handle means into a generally upright, storage position thereof automatically blocks discharge from said second fan means so as to interrupt suction air flow within said second suction channel means associated therewith.

3. A vacuum cleaner as in claim 2, wherein:

said exhaust ports have respective free, open ends which extend generally rearwardly from said chasis;

the free, open end of said one exhaust port corresponding with said second fan means extends relatively further than that of the other exhaust port by an amount adequate to engage and be sealed when said handle means with said bag means supported thereon are pivoted into a generally upright position; and the free, open end of said other exhaust port extends from said chassis by an amount less than that of said one exhaust port so that such free, open end thereof at all times remains unblocked regardless of the pivoted position of said handle means and said bag means supported thereon.

4. A vacuum cleaner as in claim 3, wherein:

the free, open end of said one exhaust port defines a planar, angled surface with the uppermost area thereof being more rearwardly projected than its remaining areas so as to sealingly mate with a correspondingly angled surface of said bag means as same is pivoted into said generally upright position thereof; and the free, open end of said other exhaust port defines a planar, angled surface with the lowermost area thereof being more rearwardly projected than its remaining areas to present an angled surface to said correspondingly angled surface of said bag means as same is pivoted into said generally upright position so as to prevent sealingly mating with same.

5. A vacuum cleaner as in claim 2, wherein:

said main suction intake port area generally comprises a forwardly-located slot situated along the underside of said chassis; and said first and second suction channel means generally comprise passageways beginning along the front of said chassis generally above and in communication with said intake port area slot, and respectively extending therefrom along opposing sides of said chassis towards the rear of same, where said suction motor means and fan means are substantially located.

6. A vacuum cleaner as in claim 5, wherein said attachment port comprises an opening defined in said chassis and extending into said first suction channel means intermediate the front and rear of said chassis, an openable accessory door for selectively closing said opening so as to retain suction air flow within said first suction channel means, and engagement means adapted for removably retaining an auxiliary hose in said opening wherein said accessory door is opened.

7. A vacuum cleaner as in claim 1, wherein:

said suction motor means includes commonly-driven first and second output shafts; and said first and second fan means are respectively rotatably driven by said first and second output shafts.

8. A vacuum cleaner as in claim 7, wherein:

said suction motor means comprises an electric motor having a common shaft extending axially therethrough so that ends thereof on opposing axial sides of said motor means comprise said commonly-driven first and second output shafts thereof; and wherein said first and second fan means each include a fan blade assembly fixedly mounted on its respective output shaft for rotation therewith, and a housing extending generally circumferentially about the fan blade assembly and defining a rearwardly directed exhaust output to facilitate discharge from the respective fan means of dust, dirt, and suction air flow directed thereto.

9. A vacuum cleaner as in claim 2, wherein:

said handle means comprises a control handle pivotably mounted on said chassis generally adjacent the rear thereof; and said bag means comprises a permanent-type fabric dirt bag carried on said control handle for pivotable movement therewith, said fabric dirt bag having a lower open end thereof which is attached to said chassis rear and which completely surrounds said exhaust ports, said fabric dirt bag also supporting therein a relatively rigid vinyl tube which has a lower open end in communication with said exhaust ports, and an open upper end adjacent an upper end of said fabric dirt bag, said open upper end of said dirt tube being adapted for interconnection with a disposable dirt bag which hangs within said permanent-type fabric dirt bag for receipt of dust and dirt discharged thereto through said dirt tube from said vacuum cleaner exhaust ports, wherein said dirt tube includes a relatively rigid, internal rear wall for being pivoted into a position during relatively upright storage of said handle for engaging said exhaust port corresponding with said second fan means for sealing a free, open end thereof.

10. An upright vacuum cleaner with improved auxiliary attachment cleaning, said vacuum cleaner comprising:

a mobile chassis comprising a main cleaning head having a main dirt intake opening;

a suction motor, carried on said chassis, and having a common output shaft means;

a pair of fan elements, one each respectively attached to said common output shaft means, for being rotatably driven by said motor as a common load thereon;

fan cover means respectively surrounding each of said pair of fan elements, and providing a suction intake port and a compression output port for each one of said pair;

a pair of air channels defined by and within said chassis, one each respectively interconnecting each suction intake port with said chassis main dirt intake opening so as to form an air passage therebetween for suction force established by rotation of said fan elements, so that dirt situated exterior to said chassis and adjacent the main dirt intake opening thereof may be suctioned into said air channels by the suction force established therein with said fan elements;

a pair of exhaust ports carried on said chassis and associated with the respective fan cover means output ports so as to conduct discharge therefrom to the exterior of said chassis;

handle means, pivotably attached to said chassis, for guiding same; and bag means, supported on said handle means for movement therewith and interconnected with said chassis so as to receive discharge from said two exhaust ports;

wherein one of said exhaust ports extends from said chassis an amount adequate so as to be sealed by contact with said bag means whenever same is pivoted with said handle means to a generally upright position, which sealing has the effect of precluding suction air flow in the corresponding fan cover means and air channel so as to in turn reduce the common load on said motor, whereby the rotational speed of said suction motor output shaft means is relatively increased, resulting in corresponding relatively increased suction force in the other air channel, said other air channel being adapted for selected alternative operative association with auxiliary attachment tools.

11. A vacuum cleaner as in claim 10, wherein said other air channel includes an auxiliary cleaning opening therein intermediate the interconnection thereof with its respective suction intake port and said chassis main dirt intake opening, said auxiliary cleaning opening being selectively covered with an accessory door which when closed maintains suction force within said other air channel as established by rotation of its corresponding fan element, and when opened permits introduction of an auxiliary hose having an extended flange which interposes in said other air channel and diverts suction force therein from said chassis main dirt intake opening into the auxiliary hose.

12. A vacuum cleaner as in claim 10, wherein said bag means includes:

a fabric outer bag, having an upper end thereof supported on an upper end of said handle means, and a lower end thereof attached to said chassis and surrounding said two exhaust ports; and a relatively rigid dirt tube supported in a fixed relative position within said outer bag, having a lower open end for receiving said exhaust ports at least partially into the interior of said dirt tube, and an upper open end adapted for attachment of a disposable bag thereto which hangs within said outer bag and through which upper open end discharge from said exhaust ports may be directed along said dirt tube.

13. A vacuum cleaner as in claim 12, wherein:

said dirt tube includes a rearwardly located lower wall portion thereof opposing the free end of said extended exhaust port and adapted for closing engagement therewith when said handle means is pivoted into a generally upright position; and said extended exhaust port includes a free end having a generally angled surface for sealingly engaging said opposing dirt tube rear wall as same is pivotably moved in the direction of said extended exhaust port free end.

14. A vacuum cleaner as in claim 10, wherein said extended exhaust port includes a free end thereof having a generally angled, planar surface for sealing engagement with an opposing generally planar, rigid portion of said bag means as same is pivoted by said handle means in the direction of said extended exhaust port.

15. A vacuum cleaner as in claim 14, wherein the other of said exhaust ports has a free end which extends from said chassis less than that of said extended one exhaust port an amount adequate so as to remain out of contact with said bag means planar portion whenever such bag means is pivoted with said handle means to a generally upright position, whereby suction air flow in said other air channel continues undiminished during operation of said suction motor and fan elements.

16. A vacuum cleaner as in claim 15, wherein the free end of said other exhaust port comprises a generally angled, planar surface, which is angled forwardly from that of said extended exhaust port free end.

17. A vacuum cleaner as in claim 15, wherein the free end of said one exhaust port extends in a range approximately from about three quarters of an inch to about one inch beyond the free end of said other exhaust port.

18. A vacuum cleaner as in claim 10, wherein:

said suction motor common output shaft means comprises a single output shaft extending axially through said motor and having output shaft drive ends emerging from opposite sides of said motor; and said pair of fan llements are respectively attached to each of said output shaft drive ends.

19. An upright vacuum cleaner adapted for principal cleaning with a mobile cleaning head and alternative cleaning with auxiliary attachment tools removably associated with such cleaning head, said vacuum cleaner comprising:

a wheel-supported mobile cleaning head having a main chassis, said chassis having a forwardly-located principal suction intake area, and a pair of suction air channels formed rearwardly from said intake area, situated along generally opposite sides of said chassis, and terminating adjacent the rear of said chassis on (such respective opposite sides, thereof;

a suction motor situated adjacent said chassis rear and located generally between the air channel terminations, said motor having a central drive shaft axially aligned between such air channel terminations and extending outward from opposing axial sides of said motor;

a pair of fan blade assemblies, one each of which is mounted on said motor drive shaft on a given axial side of said motor, for being rotated by said motor as a common load thereof in a plane generally perpendicular to the axis between said air channel terminations;

a pair of covers, one each extending circumferentially about each fan blade assembly, and each having an exhaust opening situated on the rearward side of said chassis;

a pair of generally cone-shaped members, one each interconnecting an axially outward side of each cover with a respective one of said air channel terminations, each said cone-shaped member defining a central opening therein for the passage of suction air flow through its respective air channel induced by the rotation of its respective fan blade assembly;

a pair of exhaust ports supported on the rear of said chassis and interconnecting respectively with the exhaust openings of each fan blade assembly cover, one of said exhaust ports having a free end extending relatively further rearwardly from said chassis than the other, said extended exhaust port corresponding with a predetermined one of said air channels;

a pivoting control handle attached adjacent the rear of said mobile cleaning head for guiding same;

a dust bag supported generally along the length of said control handle for pivoting movement therewith relative said chassis, and having a lower end opening thereof which surrounds said pair of exhaust ports;

a relatively rigid dirt tube supported internally within said dust bag and operatively interconnected with said exhaust ports so that same at least partially extend into a lower end opening of said dirt tube, said dirt tube having an upper end opening to permit dirt and air forced into the lower end opening thereof from said exhaust ports to be guided upwardly through and enclosed within the dirt tube so as to be deposited into the top of said dust bag; and an attachment port, associated with the air channel other than said predetermined one thereof, and adapted for selectively permitting attachment of an auxiliary hose to said cleaning head with a flange of such hose introduced into said other air channel for diverting suction air flow within said other ai channel into such hose instead of from said principal suction intake area, such hose being adapted for use with auxiliary cleaning implements manipulated independently of said mobile cleaning head;

wherein, during auxiliary cleaning with an auxiliary hose attached to said cleaning head, said control handle may be pivoted upward an amount adequate such that said relatively extended exhaust port free end is closed against an internal rear wall of said rigid dirt tube so that suction air flow within said corresponding predetermined one air channel is prevented which in turn removes air flow load from the corresponding fan blade assembly, whereby the common load on said suction motor is relatively reduced so that the rotational speed of said drive shaft thereof is relatively increased for corresponding increased suction air flow in said other air channel for improved auxiliary cleaning.

20. A vacuum cleaner as in claim 19, wherein the free end of said other exhaust port is terminated a distance adequate from said internal rear wall of said rigid dirt tube so as to remain out of contact with same whenever said control handle is pivoted upward, whereby suction air flow in said other air channel continues unrestricted.

21. A vacuum cleaner as in claim 19, wherein said relatively extended exhaust port free end defines a generally planar surface having an angle which corresponds with a generally planar angled surface forming said dirt tube internal rear wall, so that such free end may be sealed by pivoting action of said dirt tube towards such free end.

22. A vacuum cleaner as in claim 19, wherein said extended free end extends in a range approximately from about three quarters of an inch to about one inch relatively further rearwardly from said chassis than said other exhaust port free end, and wherein said exhaust ports are relatively adjacent one another so that said extended free end initially engages said dirt tube internal rear wall as it is pivoted generally towards same so as to be sealed thereby while also preventing sealing of the other exhaust port free end with such dirt tube internal rear wall.

* * * * *